US005464717A

United States Patent [19]

Sakaguchi et al.

[11] Patent Number: 5,464,717

[45] Date of Patent: Nov. 7, 1995

[54] ELECTROPHOTOGRAPHIC PHOTORECEPTOR WITH SUBBING LAYER AND CHARGE GENERATING LAYER

[75] Inventors: Yasuo Sakaguchi; Katsumi Daimon; Michiaki Takahashi; Kazuo Yamasaki; Yasuhiro Yamaguchi, all of Minami Ashigara, Japan

[73] Assignee: Fuji Xerox Co., Ltd., Tokyo, Japan

[21] Appl. No.: 252,781

[22] Filed: Jun. 2, 1994

[30] Foreign Application Priority Data

Jun. 4, 1993 [JP] Japan ..... 5-158140

[51] Int. Cl.$^6$ ..... G03G 5/10

[52] U.S. Cl. ..... 430/58; 430/65

[58] Field of Search ..... 430/60, 62, 63, 430/65

[56] References Cited

U.S. PATENT DOCUMENTS

| | | | |
|---|---|---|---|
| 5,188,916 | 2/1993 | Hodumi et al. | 430/60 |
| 5,302,479 | 4/1994 | Daimon et al. | 430/78 |

FOREIGN PATENT DOCUMENTS

| | | |
|---|---|---|
| 57-54942 | 4/1982 | Japan . |
| 60-59355 | 4/1985 | Japan . |
| 61-94057 | 5/1986 | Japan . |
| 61-203461 | 9/1986 | Japan . |
| 62-47054 | 2/1987 | Japan . |
| 62-67094 | 3/1987 | Japan . |
| 1-221459 | 9/1989 | Japan . |
| 3-4904 | 1/1991 | Japan . |
| 3-66663 | 10/1991 | Japan . |

*Primary Examiner*—John Goodrow
*Attorney, Agent, or Firm*—Oliff & Berridge

[57] ABSTRACT

An electrophotographic photoreceptor comprising a conductive substrate having thereon at least a subbing layer comprising an organometallic compound (e.g., organozirconium or organotitanium compound) and 3 to 30% by weight, based on the organometallic compound, of a compatible binder resin, a charge generating layer prepared by using a coating composition comprising hydroxygallium phthalocyanine crystals (preferably those having a novel crystal form) as a charge generating material, a binder resin, and a halogenated benzene as a dispersing medium, and a charge transporting layer in this order. The photoreceptor is excellent in sensitivity and stability on repeated use and is free from coating defects.

20 Claims, 4 Drawing Sheets

ELECTROPHOTOGRAPHIC PHOTORECEPTOR WITH SUBBING LAYER AND CHARGE GENERATING LAYER

FIELD OF THE INVENTION

This invention relates to an electrophotographic photoreceptor comprising a conductive substrate having thereon a laminate type photosensitive layer, and more particularly an electrophotographic photoreceptor in which a combination of a specific subbing layer and a specific charge generating layer is used to inhibit development of coating defects.

BACKGROUND OF THE INVENTION

In order to prevent generation of an interference fringe on a photoreceptor for laser printers, it is a practice recently followed to roughen the surface of a conductive substrate of the photoreceptor by various means. In using a substrate with a roughened surface, however, a charge generating layer formed thereon tends to suffer from coating defects, such as cissing and spitting, and charges tend to be locally injected from the substrate into the charge generating layer to cause black dots or white areas.

It is commonly known that these problems can be solved by providing a subbing layer between a conductive substrate and a charge generating layer.

Known materials for forming the subbing layer include thermoplastic resins, such as polyvinyl acetate, polyvinyl alcohol, polyvinyl butyral, polyvinyl methyl ether, polyamides, thermoplastic polyesters, phenoxy resins, casein, gelatin, and nitrocellulose; and thermosetting resins, such as polyimide, polyethyleneimine, epoxy resins, melamine resins, phenolic resins, and polyurethane resins.

However, formation of a subbing layer comprising these known resins often causes a reduction in sensitivity, deterioration of electrical-characteristics on repeated use, such as an increase in residual potential, and deterioration in image quality, such as image defects.

To overcome these problems arising from formation of a subbing layer, it has been proposed to use an organometallic compound as a main component of a subbing layer thereby inhibiting development of coating defects or image defects without inducing a reduction in sensitivity and an increase in residual potential, as disclosed in JP-A-61-94057 (the term "JP-A" as used herein means an "unexamined published Japanese patent application").

On the other hand, various proposals have been made on an organic electrophotographic photoreceptor comprising an organic photoconductive substance and a binder resin and having a laminate structure composed of a charge generating layer and a charge transporting layer, each of which performs the respective function. Known materials for the charge generating layer include polycyclic quinone pigments, perylene pigments, indigo pigments, bisimidazole pigments, quinacridone pigments, phthalocyanine pigments, monoazo pigments, biszao pigments, trisazo pigments, and other polyazo pigments. Known materials for the charge transporting layer include benzidine compounds, amino compounds, hydrazone compounds, pyrazoline compounds, oxazole compounds, oxadiazole compounds, stilbene compounds, and carbazole compounds. Studies have also been given to combinations of these charge generating materials and charge transporting materials. With respect to combinations using phthalocyanine pigments, for example, refer to JP-A-57-54942, JP-A-60-59355, JP-A-61-203461, JP-A-62-47054, and JP-A-62-67094.

Under these circumstances, when the conventional organic charge generating materials are used in electrophotographic photoreceptors for copying machines, laser printers, LED printers, etc., the photoreceptors still have problems waiting for solution, such as poor chargeability and poor stability on repeated use.

In general, an electrophotographic photoreceptor should satisfy the following conditions for obtaining high sensitivity and stable electrophotographic characteristics on repeated use. (1) The charge generating material should generate charges efficiently in response to absorbed light. (2) The thus generated positive holes should be smoothly injected from the charge generating layer into the charge transporting layer. (3) The generated electrons should efficiently be injected from the charge generating layer to the subbing layer and exchange charges with the conductive substrate via the subbing layer thereby to inhibit accumulation of charges in the charge generating layer while preventing injection of positive holes from the conductive substrate.

That is, even if a charge generating material capable of efficiently generating charges and a charge transporting material capable of transporting the charges at a high speed are combined to satisfy the conditions (1) and (2), high sensitivity and stable electrophotographic characteristics on repeated use can never be assured unless a combination of a charge generating material and a subbing layer fulfills the condition (3).

An ideal electrophotographic photoreceptor would satisfy not only the above-mentioned conditions but all the other requirements, such as electrophotographic characteristics, e.g., sensitivity, accepted potential, potential retention, potential stability, residual potential, and spectral characteristics; mechanical durability, e.g., abrasion resistance; and chemical stability against heat, light, discharging products, and the like. However, it is very difficult to choose a combination of materials which satisfy all these requirements. A combination of a charge generating material and a subbing layer which satisfies the above conditions sufficiently has not yet been obtained.

Turning attention to production of an electrophotographic photoreceptor, solvents to be used in successive formation of a subbing layer, a charge generating layer, and a charge transporting layer on a substrate should be selected carefully. That is, a solvent to be used for formation of a layer should be capable of dispersing or dissolving all the materials for the layer to provide a composition suitable to be applied and, at the same time, must not disturb the structure of a lower layer.

SUMMARY OF THE INVENTION

An object of the present invention is to provide an electrophotographic photoreceptor which has high sensitivity and excellent stability on repeated use and is free from coating defects.

The inventors have extensively studied combinations of various materials constituting a subbing layer and a charge generating layer of a laminate type photoreceptor. As a result, it has now been found that a photoreceptor comprising a subbing layer prepared from a specific material and a charge generating layer prepared from a coating composition containing a specific charge generating material and a specific dispersing medium is excellent in sensitivity and stability on repeated use and free from coating defects.

The present invention provides an electrophotographic photoreceptor comprising a conductive substrate having thereon at least a subbing layer, a charge generating layer, and a charge transporting layer in this order, in which the subbing layer mainly comprises an organometallic compound and a binder resin compatible with the organometallic compound, and the charge generating layer is a layer prepared by using a coating composition comprising hydroxygallium phthalocyanine crystals as a charge generating material, a binder resin, and a halogenated benzene as a dispersing medium.

The subbing layer may be a layer mainly comprising an organometallic compound, a silane coupling agent, and a binder resin compatible with both the organometallic compound and the silane coupling agent.

The binder resin in the subbing layer is preferably used in an amount of from 3 to 30% by weight based on the total amount of the organometallic compound and the silane coupling agent. The organometallic compound is preferably an organozirconium compound or an organotitanium compound.

The hydroxygallium phthalocyanine compound preferably includes (a) novel hydroxygallium phthalocyanine crystals having intense peaks at Bragg angles (20±0.2°) of 7.78°, 16.5°, 25.1°, and 26.6° in X-ray diffraction using CuKα as a radiation source (hereinafter simply referred to as X-ray diffraction peaks), (b) novel hydroxygallium phthalocyanine crystals having intense X-ray diffraction peaks at Bragg angles (20±0.2°) of 7.9°, 16.5°, 24.4°, and 27.6°, (c) novel hydroxygallium phthalocyanine crystals having intense X-ray diffraction peaks at Bragg angles (20±0.2°) of 7.5°, 9.9°, 12.5°, 16.3°, 18.6°, 25.1°, and 28.3°, (d) novel hydroxygallium phthalocyanine crystals having intense X-ray diffraction peaks at Bragg angles (20±0.2°) of 6.8°. 12.8°, 15.8°, and 26.0°, and (e) novel hydroxygallium phthalocyanine crystals having intense X-ray diffraction peaks at Bragg angles (20±0.2°) of 7.0°, 13.4°, 16.6°, 26.0°, and 26.7°.

The electrophotographic photoreceptor of the present invention has high sensitivity and excellent stability on repeated use and inhibits development of coating defects by using the hydroxy hydroxygallium phthalocyanine crystals and a halogenated benzene as a dispersing medium regardless of the presence of a subbing layer on a conductive substrate.

DETAILED DESCRIPTION OF THE INVENTION

Figure 1:
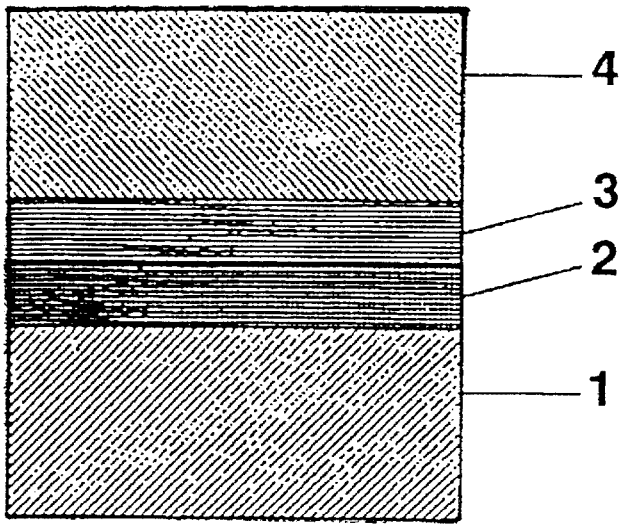
FIGS. 1 and 2 each show a schematic cross section of the electrophotographic photoreceptor according to the present invention.
Figure 2:
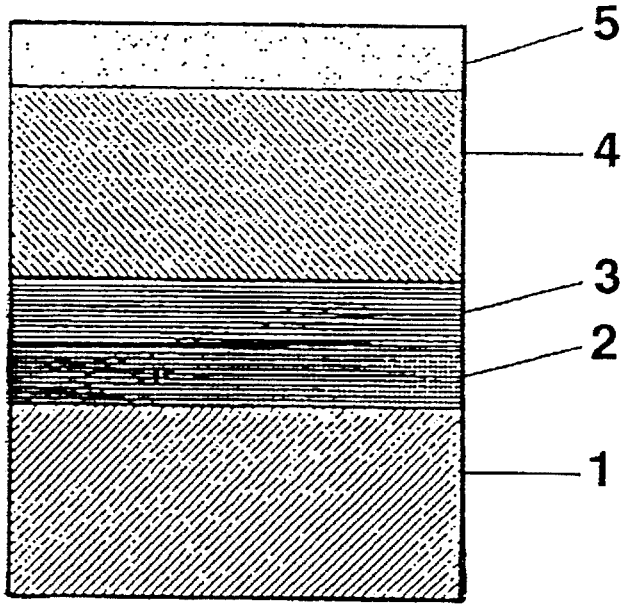

The layer structure of the electrophotographic photoreceptor of the present invention is shown in FIGS. 1 and 2. The photoreceptor of FIG. 1 comprises conductive substrate 1 having thereon subbing layer 2, charge generating layer 3, and charge transporting layer 4 in this order. The photoreceptor may have protective layer 5 on the surface thereof as shown in FIG. 2.

The conductive substrate which can be used in the present invention includes metals, e.g., aluminum, nickel, chromium, and stainless steel; plastic films having thereon a thin film of aluminum, titanium, nickel, chromium, stainless steel, gold, vanadium, tin oxide, indium oxide, indium-tin oxide (ITO), etc.; and paper or plastic films coated or impregnated with a conductivity-imparting agent. While not limiting, the conductive substrate usually has a drum shape, a sheet shape, or a plate shape.

If desired, the conductive substrate may be subjected to various surface treatments as far as the image quality is not impaired. For example, it is subjected to an oxidation treatment, a chemical treatment, a coloring treatment, or a non-specular finish, such as surface graining.

The subbing layer comprises an organometallic compound and a binder resin compatible with the organometallic compound. The organometallic compound preferably includes an organozirconium compound and an organotitanium compound.

The organozirconium compound includes a zirconium alkoxide (zirconic ester), a polyorthozirconic ester, and a zirconium chelate compound. Examples of the zirconium alkoxide are zirconium tetra-n-propoxide and zirconium tetran n-butoxide.

The polyorthozirconic ester is represented by formula (I):

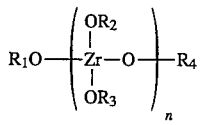

(I)

wherein $R_1$, $R_2$, $R_3$,and $R_4$, which may be the same or different, each represent a hydrocarbon residue preferably having 1 to 20 carbon atoms, such as a methyl group, an ethyl group, an n-propyl group, an isopropyl group, an n-butyl group, an isobutyl group, a hexyl group, a nonyl group, a cetyl group, a stearyl group, a cyclohexyl group, a phenyl group, a tolyl group, or a benzyl group; and n represents an integer of 2 or greater, preferably an integer of 2 to 10.

Preferred examples of the polyorthozirconic ester of formula (I) are polymethyl zirconate, polyethyl zirconate, poly-n-propyl zirconate, and poly-n-butyl zirconate.

The zirconium chelate compound includes a compound represented by formula (II):

$$Zr(L)_mX_{4-m} \quad \text{(II)}$$

wherein L represents a ligand; X represents a hydrocarbon residue (the above-described specific examples are included), an alkoxy group corresponding to the above-enumerated hydrocarbon residue, a substituted or unsubstituted aryloxy group preferably having 6 to 20 carbon atoms, or an acyloxy group preferably having 2 to 20 carbon atoms; and m represents an integer of from 1 to 4.

In formula (II), the ligand represented by includes a glycol, such as hexanediol or octanediol; a β-diketone, such as acetylacetone; a hydroxycarboxylic acid, such as lactic acid, malic acid, tartaric acid or salicylic acid; a keto-acid ester, such as acetoacetic ester; a keto-alcohol, such as diacetone alcohol; and an amino-alcohol, such as diethanolamine or triethanolamine. Examples of an aryloxy group in X include phenoxy, methyl phenoxy and naphthoxy. Examples of an acyloxy group in X include acetoxy, propionyloxy and benzoyloxy.

Specific examples of suitable zirconium chelate compounds are tetrakisacetylacetonatozirconium, bisacetylacetonatobisbutoxyzirconium, acetylacetonatotrisbutoxyzirconium, acetoacetatotrisethylzirconium, acetoacetatobutoxybisethylzirconium, acetoacetatoethylbisbutoxyzirconium, lactatobisbutoxyethylzirconium, acetoacetatobisacetylacetonatoethylzirconium, acetoacetatoacetylacetonatobisethylzirconium, and lactatobisacetylacetonatoethylzirconium.

The zirconium chelate compound also includes a compound represented by formula (III):

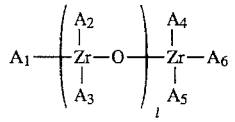

(III)

wherein $A_1$, $A_2$, $A_3$, $A_4$, $A_5$, and $A_6$, which may be the same or different, each represent an alkoxy group or a ligand, provided that at least one of them is a ligand; 1 represents an integer of from 1 to 20, preferably an integer of 1 to 9.

In formula (III), the alkoxy group include those corresponding to the above-enumerated hydrocarbon residue, and the ligand includes those enumerated above.

Preferred examples of the organotitanium compound include titanium equivalents of the above-mentioned organozirconium compounds, such as titanium chelate compounds, e.g., tetrakisacetylacetonatotitanium, bisacetylacetonatobisbutoxytitanium, acetylacetonatotrisbutoxytitanium, acetoacetatotrisethyltitanium, acetoacetatobutoxybisethyltitanium, acetoacetatobisbutoxyethyltitanium, lactatobisbutoxyethyltitanium, acetoacetatobisacetylacetonatoethyltitanium, acetoacetatoacetylacetonatobisethyltitanium, and lactatobisacetylacetonatoethyltitanium; and titanium alkoxides, e.g., titanium n-propoxide and titanium n-butoxide.

The subbing layer may further comprise a silane coupling agent. Specific examples of suitable silane coupling agents are vinyltrichlorosilane, vinyltriethoxysilane, vinyltris(β-methoxyethoxy)silane, δ-glycidoxypropyltrimethoxysilane, δ-acryloxypropyltrimethoxysilane, δ-methacryloxypropyltrimethoxysilane, δ-aminopropyltriethoxysilane, N-(β-aminoethyl)-δ-aminopropyltrimethoxysilane, N-(β-aminoethyl)-δ-aminopropylmethyldimethoxysilane, δ-chloropropyltrimethoxysilane, δ-mercaptopropyltrimethoxysilane, methyltrimethoxysilane, dimethyldimethoxysilane, trimethylmethoxysilane, diphenyldimethoxysilane, phenyltrimethoxysilane, and diphenyldiethoxysilane.

The binder resin which can be used in the subbing layer includes polyurethane resins, polyvinyl butyral resins, polyvinyl formal resins, and polyvinyl acetate resins.

The above-mentioned organometallic compounds, binder resins, and silane coupling agents may be each used either individually or in combination of two or more thereof.

The silane coupling agent is used in an amount up to 30% by weight based on the organometallic compound. The binder resin should be used in an amount of from 3 to 30% by weight based on the total amount of the organometallic compound and the silane coupling agent. If the proportion of the binder resin is less than 3% by weight, the subbing layer, if formed to an increased thickness, tends to suffer from cracks. If it exceeds 30% by weight, the coating composition tends to gel, and the resulting photoreceptor tends to have deteriorated electrophotographic characteristics, particularly reduced sensitivity in a low temperature and low humidity environment and increased residual potential.

A subbing layer can be formed by applying a coating composition prepared by dissolving the above-mentioned materials in a solvent on a conductive substrate by an ordinary method, such as blade coating, wire bar coating, spray coating, dip coating, bead coating, air knife coating or curtain coating, followed by drying at a temperature of from 100° to 300° C. The solvent which can be used in the formation of the subbing layer are, not limited, preferably an aromatic solvent, an aliphatic hydrocarbon or an alcoholic solvent, more preferably an alcoholic solvent such as butanol, ethanol and methanol. The thickness of the subbing layer is arbitrary between 0.1 μm and 10 μm, and preferably from 0.1 to 1.5 μm.

A charge generating layer is formed-by applying a coating composition prepared by dispersing a charge generating material in a binder resin and a dispersing medium on the subbing layer, followed by drying.

In the present invention, hydroxygallium phthalocyanine crystals are used as a charge generating material. The hydroxygallium phthalocyanine crystals which can preferably be used in the present invention include (a) hydroxygallium phthalocyanine crystals having intense X-ray diffraction peaks at Bragg angles (20±0.2°) of 7.78°, 16.5°, 25.1°, and 26.6°, (b) hydroxygallium phthalocyanine crystals having intense X-ray diffraction peaks at Bragg angles (20±0.2°) of 7.9°, 16.5°, 24.2°, and 27.6°, (c) hydroxygallium phthalocyanine crystals having intense X-ray diffraction peaks at Bragg angles (20±0.2°) of 7.5°, 9.9°, 12.5°, 16.3°, 18.6°, 25.1°, and 28.3°, (d) hydroxygallium phthalocyanine crystals having intense X-ray diffraction phthalocyanine crystals having intense X-ray diffraction peaks at Bragg angles (20±0.2°) of 6.8.20 , 12.8°, 15.8°, and 26.0°, and (e) hydroxygallium phthalocyanine crystals having intense X-ray diffraction peaks at Bragg angles (20±0.2°) of 7.0°, 13.4°, 16.6°, 26.0°, and 26.7°.

In the present invention, the X-ray diffraction pattern in the measurement results of intensities of the Bragg angle (2θ) respect to CuKα characteristic X-ray (wavelength: 1.541 Å). The measurement conditions are as follows:

Apparatus: X-ray diffractiometer (RAD-RC produced by Rigaku K. K.)

Target: Cu (1.54050 Å)

Voltage: 40.0 KV

Stage angle: 5.00 deg

Stop angle: 40.00 deg

Step angle: 0.020 deg

The hydroxygallium phthalocyanine crystals (a) to (d) all have a novel crystal form and can be prepared as follows.

Chlorogallium phthalocyanine obtainable by a known process is subjected to acid pasting or hydrolysis in an acid or an alkaline solution to synthesize hydroxygallium phthalocyanine. The resulting hydroxygallium phthalocyanine is then subjected to a solvent treatment to obtain a desired crystal form. Before being put to a solvent treatment, the synthesized hydroxygallium phthalocyanine may be ground and rendered amorphous. Alternatively, the hydroxygallium phthalocyanine is wet ground together with a solvent in a ball mill, etc. to obtain a desired crystal form.

The solvent which can be used in the above-described treatments are selected from generally employed solvents.

More specifically, alcohols (e.g., methanol and ethanol), polyhydric alcohols (e.g., ethylene glycol, glycerin, and polyethylene glycol), sulfoxides (e.g., dimethyl sulfoxide), aromatic hydrocarbons (e.g., toluene and chlorobenzene), mixtures thereof, and mixtures of these organic solvents and water are useful for obtaining the hydroxygallium phthalocyanine crystal (a);-amides (e.g., dimethylformamide (DMF) and N-methylpyrrolidone), organic amines (e.g., pyridine and piperidine), sulfoxides (e.g., dimethyl sulfoxide), mixtures thereof, and mixtures of these organic solvents and water are useful for obtaining the hydroxygallium phthalocyanine crystal (b); amides (e.g., DMF and N-methylpyrrolidone), esters (e.g., ethyl acetate and butyl acetate), ketones (e.g., acetone and methyl ethyl ketone), mixtures thereof, and mixtures of these organic solvents and water are useful for obtaining the hydroxygallium phthalocyanine crystal (c); and polyhydric alcohols (e.g., ethylene glycol, glycerin, and polyethylene glycol) are useful for obtaining the hydroxygallium phthalocyanine crystal (d).

In the preparation of the hydroxygallium phthalocyanine crystals (a) to (d), the solvent is used in an amount ranging from 1 to 200 parts by weight, and preferably from 10 to 100 parts by weight, per part by weight of hydroxygallium phthalocyanine. The solvent treatment can be carried out at a temperature of from 0° to 150° C., and preferably from room temperature to 100° C.

The hydroxygallium phthalocyanine crystal (e) is preferably prepared by carrying out the acid pasting using a mixed solvent system or a suspension comprising an organic solvent (e.g., methanol, acetone, ethylene glycol or dichloromethane) and an aqueous alkali solution.

Binder resins to be used in the charge generating layer can be chosen from a broad range of insulating resins, such as polyvinyl butyral resins, polyarylate resins (e.g., a polycondensate of bisphenol A and phthalic acid), polycarbonate resins, polyester resins, modified ether type polyester resins, phenoxy resins, vinyl chloride-vinyl acetate copolymers, polyamide resins, acrylic resins, polyacrylamide resins, polyvinylpyridine resins, cellulose resins, urethane resins, epoxy resins, polyvinyl alcohol, polyvinyl pyrrolidone, and casein. Organic photoconductive polymers, such as poly-N-vinylcarbazole, polyvinyl anthracene, polyvinylpyrene, and polysilane, can also be used. These binder resins may be used either individually or in combination of two or more thereof.

A weight ratio of the hydroxygallium phthalocyanine crystals to the binder resin is preferably from 10:1 to 1:10.

The dispersing medium which can be used in the coating composition for the charge generating layer is a halogenated benzene, such as chlorobenzene, dichlorobenzene, and bromobenzene.

The hydroxygallium phthalocyanine crystals are dispersed in the solution of the above-described binder resin in the above-described dispersing medium by a general means, e.g., a ball mill, an attritor or a sand mill. Cares should be taken so as not to change the crystal form of the hydroxygallium phthalocyanine by the dispersing operation. The inventors have confirmed that the crystal form is not changed by any of the above-mentioned dispersion methods. It is effective to finely disperse the crystals to a ;particle size of not greater than 0.5 μm, preferably not greater than 0.3 μm, and more preferably not greater than 0.15μm.

Application of the coating composition is effected by an ordinary method, such as blade coating, wire bar coating, spray coating, dip coating, bead coating, air knife coating or curtain coating. After coating, the coating composition is dried by air drying, or at a temperature of 200° C. or less for 1 hour or less. The charge generating layer usually has a thickness of from 0.1 to 5 μm, and preferably from 0.1 to 2.0 μm.

On the thus formed charge generating layer is provided a charge transporting layer. The charge transporting layer can be formed by using a coating composition comprising a charge transporting material and an appropriate binder resin.

Any of known charge transporting materials can be utilized. Examples of suitable charge transporting materials include benzidine compounds, amino compounds, hydrazone compounds, pyrazoline compounds, oxazole compounds, oxadiazole compounds, stilbene compounds, and carbazole compounds. In addition, organic photoconductive polymers, as poly-N-vinylcarbazole, polyvinylpyrene, polyvinylanthracene, polyvinylacridine, and polysilane, may also be used as a charge transporting material. These charge transporting materials may be used either individually or in combination of two or more thereof.

Binder resins which can be used in the charge transporting layer can be selected from known binder resins, such as polycarbonate resins, polyester resins, methacrylic resins, acrylic resins, polyvinyl chloride resins, polyvinylidehe chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, and poly-N-vinylcarbazole resins. These binder resins may be used either individually or in combination of two or more thereof.

Application of the coating composition is effected by an ordinary method, such as blade coating, wire bar coating, spray coating, dip coating, bead coating, air knife coating or curtain coating. The charge transporting layer usually has a thickness of from 5 to 50 μm, and preferably of from 10 to 30 μm.

For the purpose of preventing deterioration of a photoreceptor due to ozone or oxidizing gases generated in a copying machine or heat and light, antioxidants, photostabilizers, heat stabilizers, or the like additives may be added to the charge generating layer and/or the charge transporting layer.

Examples of usable antioxidants include hindered phenols, hindered amines, p-phenylenediamine, an arylalkane, hydroquinone, spirocoumarone, spiroindanone, derivatives of these compounds, organic sulfur compounds, and organic phosphorus compounds.

Examples of usable photostabilizers are benzophenone, benzotriazole, dithiocarbamate, tetramethylpiperidine, and derivatives thereof.

For the purpose of improving sensitivity, reducing a residual potential, and reducing fatigue from repeated use, one or more electron accepting substances may be incorporated into the subbing layer, the charge generating layer and/or the charge transporting layer. Suitable examples of electron accepting substances which can be used in the present invention are succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Preferred of them are fluorenone type compounds, quinone type compounds, and benzene derivatives having an electron-withdrawing substituent, e.g., Cl, CN or $NO_2$.

If desired, a protective layer may be provided on the charge transporting layer. A protective layer serves not only for prevention of chemical denaturation of the charge transporting layer on charging but for improvement of mechanical strength of the photoreceptor.

The protective layer is formed by applying a coating composition comprising a conductive material and an appropriate binder resin. Examples of suitable conductive materials include metallocene compounds (e.g., 1,1'-dimethylferrocene), aromatic amine compounds (e.g., N,N'-diphenyl-N,N'-bis(m-tolyl)benzidine), and metal oxides (e.g., antimony oxide, tin oxide, titanium oxide, indium oxide, and tin oxide-antimony oxide). Of them, preferred are conductive metal oxides (e.g., tin oxide, titanium oxide, indium oxide and the composite thereof; a small amount of antimony oxide may be added thereto.) Especially, a composite of tin oxide and antimony oxide is preferred. The conductive metal oxide has an average particle size of 0.05 to 0.3 μm and has a volume resistivity of $5\times10^3$ Ω·cm or more, preferably from $5\times 10^5$ to $10^9$ Ω·cm. The conductive material may be used in an amount of from 10 to 50 wt % of the binder resin in the protective layer. Examples of usable binder resins include polyamide resins, polyurethane resins, polyester resins, epoxy resins, polyketone resins, polycarbonate resins, polyvinyl ketone resins, polystyrene resins, and polyacrylamide resins, besides binder resins for the above photosensitive layer can be also used.

The composition of the protective group is preferably designed so as to have an electrical resistivity of from $10^9$ to $10^{14}$ Ω·cm. If the protective group has a resistivity of higher than $10^{-}$Ω·cm, the residual potential would be increased to cause image fog. If the resistivity is less than $10^9$ Ω·cm, the resolving power would be reduced to cause image blurs. Further, the protective layer must not interfere with transmission of light for imagewise exposure.

Application of the coating composition for the protective layer is effected by an ordinary method, such as blade coating, wire bar coating, spray coating, dip coating, bead coating, air knife coating or curtain coating. The thickness of the protective layer is usually from 0.5 to 20 μm, and preferably from 1 to 10 μm.

The present invention will now be illustrated in greater detail with reference to Synthesis Examples and Examples, but it should be understood that the present invention is not deemed to be limited thereto. All the parts are given by weight. The powder X-ray diffractometry was conducted using CuKα as a radiation source.

SYNTHESIS EXAMPLE 1

To 200 ml of α-chloronaphthalene were added 20 parts of gallium trichloride and 58.2 parts of phthalonitrile. The mixture was allowed to react at 200° C. in a nitrogen stream for 4 hours, and the produced chlorogallium-phthalocyanine crystals were collected by filtration. The collected wet cake was dispersed in 200 ml of DMF and heated at 100° C. for 60 minutes with stirring, followed by filtration. The wet cake was thoroughly washed with methanol and dried to obtain 29.1 parts of chlorogallium phthalocyanine crystals.

Figure 3:
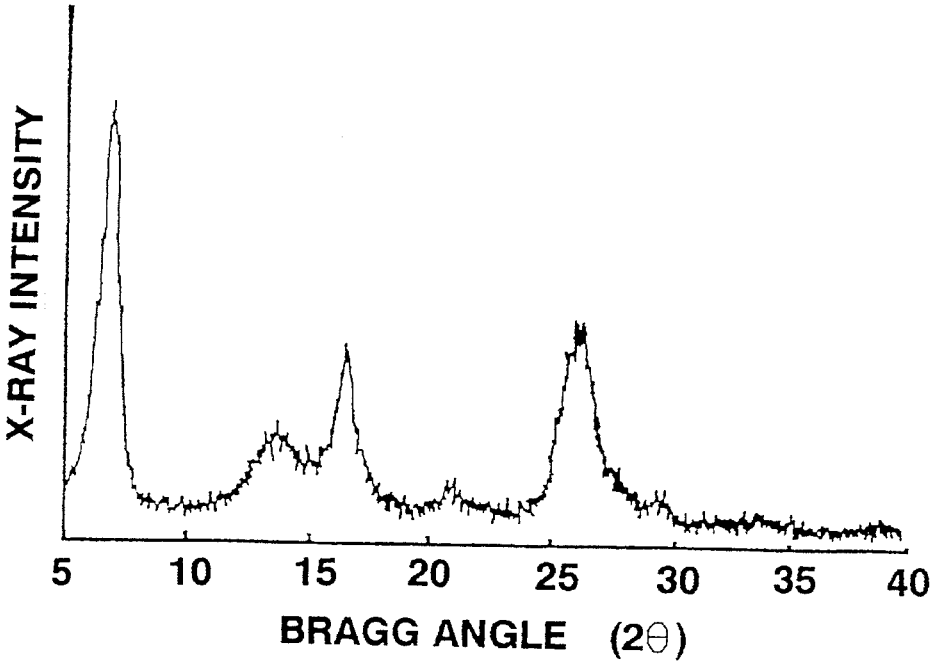
FIGS. 3 through 8 are each a powder X-ray diffraction pattern of the hydroxygallium phthalocyanine crystals obtained in Synthesis Examples 1 to 6, respectively.

Two parts of the resulting crystals were dissolved in 50 parts of concentrated sulfuric acid. After stirring for 2 hours, the solution was added dropwise to an ice-cooled mixture of 174 ml of distilled water and 106 ml of concentrated aqueous ammonia to precipitate crystals. There was obtained 1.8 parts of hydroxygallium phthalocyanine crystals. The powder X-ray diffraction pattern of the crystals is shown in FIG. 3.

SYNTHESIS EXAMPLE 2

Figure 4:
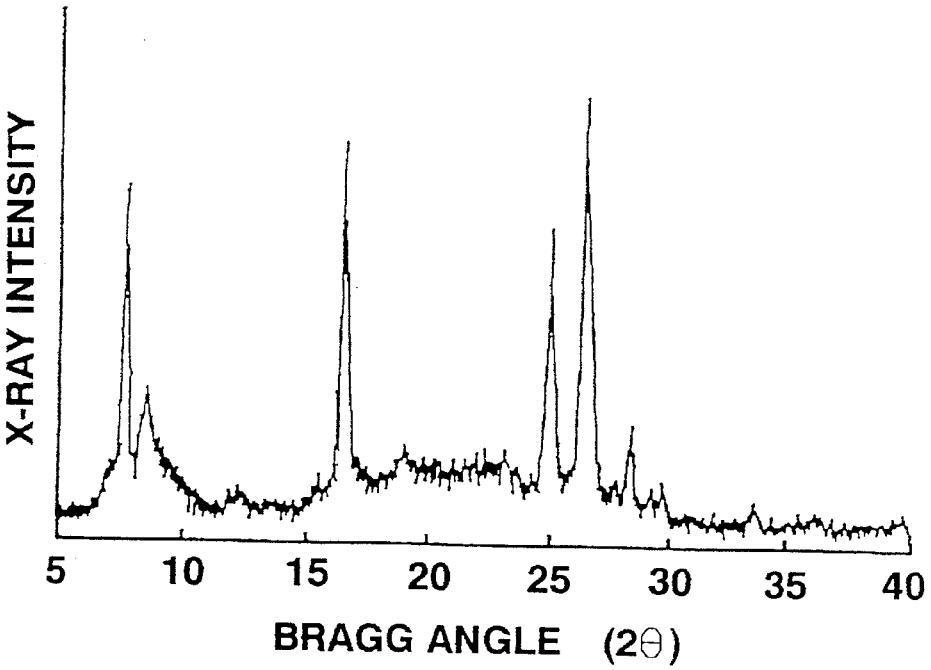

To 15 parts of chlorobenzene was added 0.5 part of the hydroxygallium phthalocyanine crystals obtained in Synthesis Example 1. After stirring the mixture at room temperature for 17 hours, the crystals were separated, washed with methanol, and dried to recover 0.4 part of hydroxygallium phthalocyanine crystals. The powder X-ray diffraction pattern of the crystals is shown in FIG. 4.

SYNTHESIS EXAMPLE 3

Figure 5:
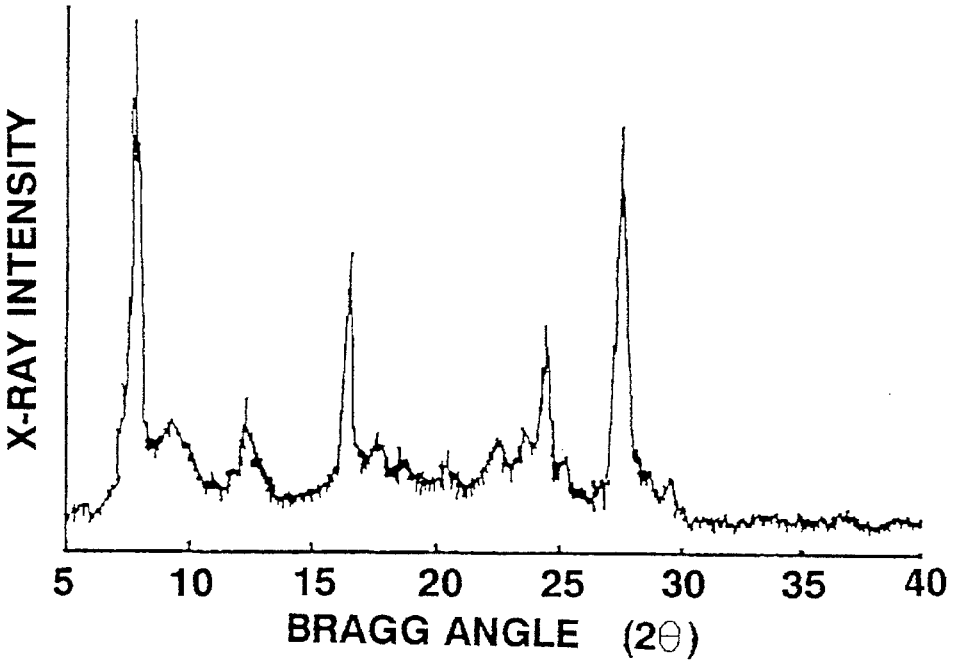

The hydroxygallium phthalocyanine crystals (0.5 part) obtained in Synthesis Example 1 was subjected to milling together with 15 parts of dimethyl sulfoxide and 30 parts of glass beads having a diameter of 1 mm for 24 hours. The crystals were separated, washed with methanol, and dried to obtain 0.4 part of hydroxygallium phthalocyanine crystals. The powder X-ray diffraction pattern of the crystals is shown in FIG. 5.

SYNTHESIS EXAMPLE 4

Figure 6:
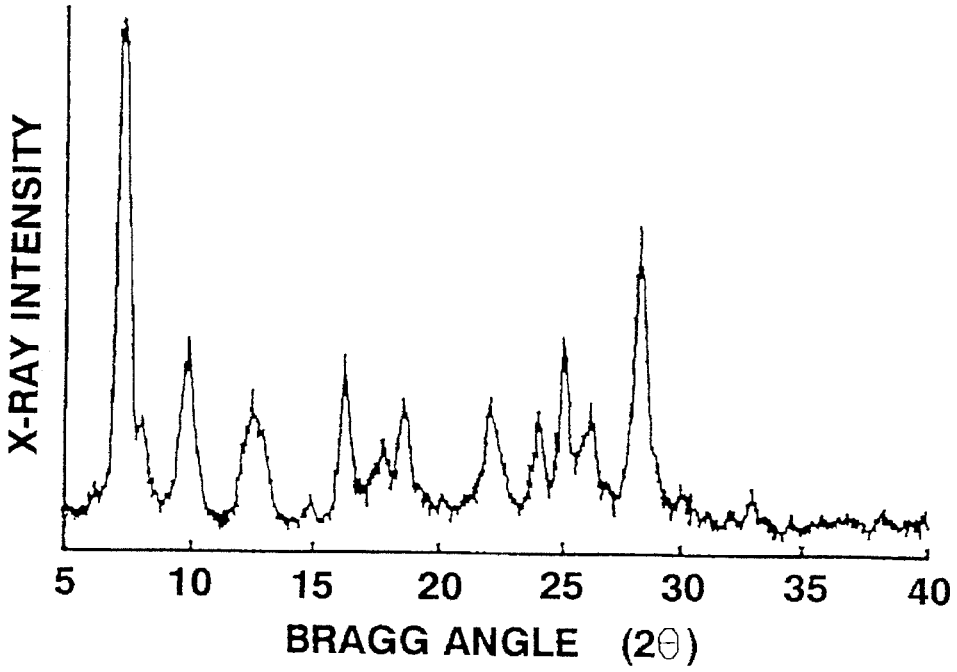

The hydroxygallium phthalocyanine crystals (0.5 part) obtained in Synthesis Example 1 was subjected to milling together with 15 parts of DMF and 30 parts of glass beads having a diameter of 1 mm for 24 hours. The crystals were separated, washed with n-butyl acetate, and dried to obtain 0.4 part of hydroxygallium phthalocyanine crystals. The powder X-ray diffraction pattern of the crystals is shown in FIG. 6.

SYNTHESIS EXAMPLE 5

Figure 7:
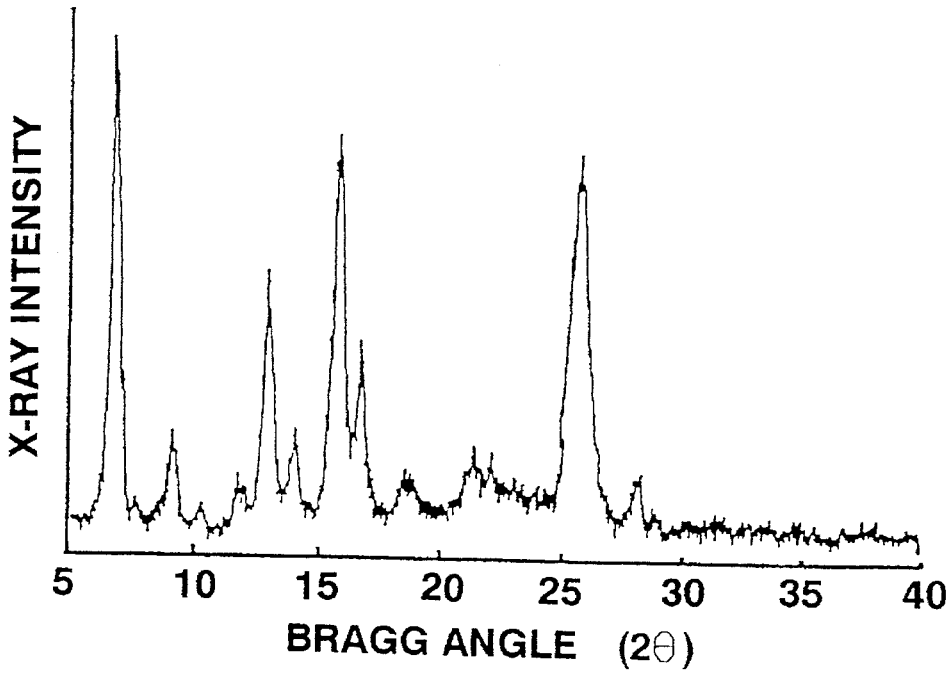

To 5 parts of ethylene glycol was added 0.5 part of the hydroxygallium phthalocyanine crystals obtained in Synthesis Example 1. After stirring the mixture at 100° C. for 7 hours, the crystals were separated, washed with methanol, and dried to recover 0.4 part of hydroxygallium phthalocyanine crystals. The powder X-ray diffraction pattern of the crystals is shown in FIG. 7.

SYNTHESIS EXAMPLE 6

Figure 8:
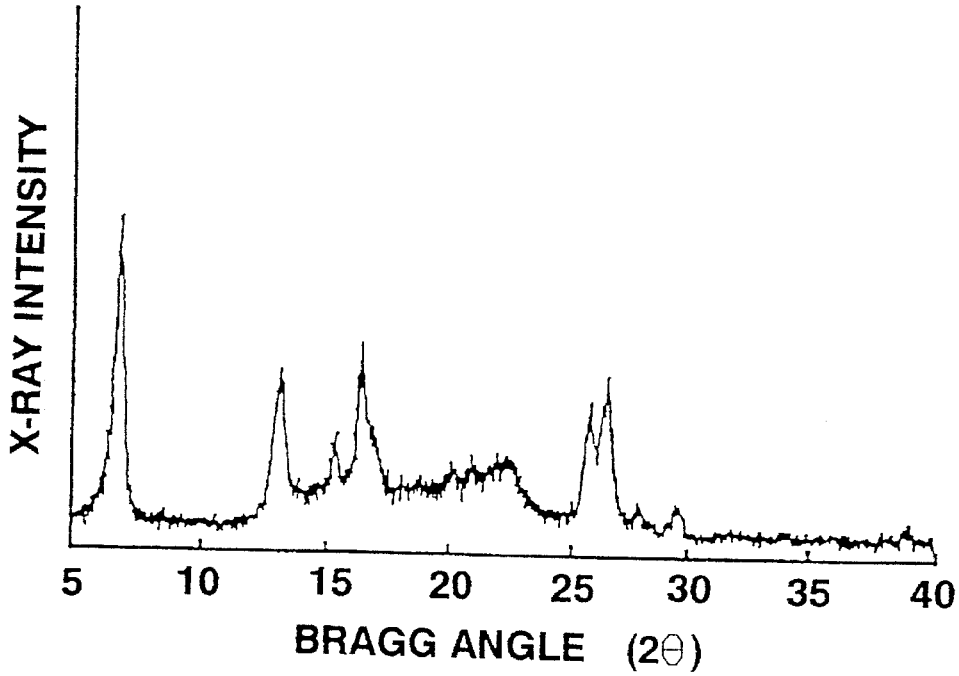

Two parts of the chlorogallium phthalocyanine crystals obtained in Synthesis Example 1 were dissolved in 50 parts of concentrated sulfuric acid. After stirring for 2 hours, the solution was added dropwise to-an ice-cooled mixture of 75 ml of distilled water, 75 ml of concentrated aqueous ammonia, and 150 ml of dichloromethane to precipitate crystals. The crystals were thoroughly washed with distilled water and dried to obtain 1.8 parts of hydroxygallium phthalocyanine crystals. The powder X-ray diffraction pattern of the crystals is shown in FIG. 8.

EXAMPLE 1

An aluminum pipe having a diameter of 40 mm and a length of 318 mm was dip coated with a solution having the following composition. The coating film was dried at 150° C. for 10 minutes to form a subbing layer having a thickness of 0.9 μm.

| Coating Composition for Subbing Layer: | |
|---|---|
| Zirconium compound of formula: | 8 parts |
| 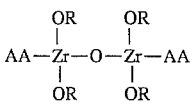 | |
| (wherein R is a butyl group; and AA is an acetylacetoxy group) | |
| Polyvinyl butyral resin (S-Lec BM-S, produced by Sekisui Chemical Co., Ltd.) | 1.5 parts |
| n-Butyl alcohol | 70 parts |

A mixture of 1 part of the hydroxygallium phthalocyanine obtained in Synthesis Example 5, 1 part of a polyvinyl butyral resin (S-Lec BM-S), and 100 parts of chlorobenzene was dispersed together with glass beads in a paint shaker for 1 hour. The resulting coating composition was applied on the subbing layer by dip coating and dried at 100° C. for 10 minutes to form a charge generating layer having a thickness of 0.15 μm. It was confirmed by X-ray diffractometry that the crystal form of the hydroxygallium phthalocyanine did not change by dispersing.

Two parts of N,N'-diphenyl-N,N'-bis(m-tolyl)benzidine and 3 parts of poly(4,4'-cyclohexylidene diphenylene carbonate) were dissolved in 20 parts of chlorobenzene, and the resulting solution was applied on the charge generating layer by dip coating and dried at 120° C. for 1 hour to form a charge transporting layer having a thickness of 23 μm.

There was thus obtained an electrophotographic photoreceptor containing novel hydroxygallium phthalocyanine crystals in its charge generating layer.

EXAMPLE 2

An electrophotographic photoreceptor was prepared in the same manner as in Example 1, except that the subbing layer was prepared by using the following coating composition.

| Coating Composition for Subbing Layer: | |
|---|---|
| Zirconium compound of formula: | 8 parts |
| 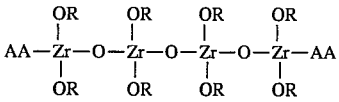 | |
| (wherein R is a butyl group; and AA is an acetylacetoxy group) | |
| Polyvinyl butyral resin (S-Lec BM-S) | 1.5 parts |
| n-Butyl alcohol | 70 parts |

EXAMPLE 3

An electrophotographic photoreceptor was prepared in the same manner as in Example 1, except that the subbing layer was prepared by using the following coating composition, and the thickness of the subbing layer was changed to 0.7 μm.

| Coating Composition for Subbing Layer: | |
|---|---|
| Zirconium butyrate (Orgatics ZA60, produced by Matsumoto Seiyaku Kogyo K. K.) | 4 parts |
| Acetylacetonezirconium butyrate (Orgatics ZC540, produced by Matsumoto Seiyaku Kogyo K. K.) | 10 parts |
| Polyvinyl butyral resin (S-Lec BM-S) | 1.5 parts |
| n-Butyl alcohol | 70 parts |

EXAMPLE 4

An electrophotographic photoreceptor was prepared in the same manner as in Example 1, except that the subbing layer was prepared by,using the following coating composition, and the thickness of the subbing layer was changed to 0.7 μm.

| Coating Composition for Subbing Layer: | |
|---|---|
| Zirconium butyrate (Orgatics ZA60, produced by Matsumoto Seiyaku Kogyo K. K.) | 20 parts |
| γ-Aminopropyltriethoxysilane A1100, produced by Nippon Unicar Co., Ltd.) | 2 parts |
| Polyvinyl butyral resin (S-Lec BM-S) | 1.5 parts |
| n-Butyl alcohol | 70 parts |

EXAMPLE 5

An electrophotographic photoreceptor was prepared in the same manner as in Example 1, except for replacing the polyvinyl butyral resin in the coating composition for the subbing layer of EXAMPLE 4 with a polyvinyl formal resin (Denka Formal #20, produced by Denka K. K.).

EXAMPLE 6

An electrophotographic photoreceptor was prepared in the same manner as in Example 1, except that the subbing layer was prepared by using the following coating composition.

| Coating Composition for Subbing Layer: | |
|---|---|
| Acetylacetonatotitanium (Orgatics TC100, produced by Matsumoto Seiyaku Kogyo K. K.) | 10 parts |
| γ-(2-Aminoethyl)aminopropyl-trimethoxysilane | 1 part |
| Polyvinyl butyral resin (S-Lec BM-1, produced by Sekisui Chemical Co., Ltd.) | 1.5 parts |
| Isopropyl alcohol | 70 parts |

An electrophotographic photoreceptor was prepared in the same manner as in Example 1, except for using the hydroxygallium phthalocyanine crystals obtained in Synthesis Example 6 as a charge generating material.

EXAMPLE 8

An electrophotographic photoreceptor was prepared in the same manner as in Example 1, except that the subbing layer was prepared by using the following coating composition.

| Coating Composition for Subbing Layer: | |
|---|---|
| Zirconium butyrate (Orgatics ZA60) | 4 parts |
| Acetylacetonezirconium butyrate (Orgatics ZC540) | 10 parts |
| Polyvinyl butyral resin (S-Lec BM-S) | 5 parts |
| n-Butyl alcohol | 70 parts |

COMPARATIVE EXAMPLE 1

An electrophotographic photoreceptor was prepared in the same manner as in Example 1, except that the subbing layer was prepared by using the following coating composition.

| Coating Composition for Subbing Layer: | |
|---|---|
| Copolymer nylon (Aramine CM8000, produced by Toray Industries, Inc.) | 10 parts |
| Ethyl alcohol | 80 parts |

COMPARATIVE EXAMPLE 2

An electrophotographic photoreceptor was prepared in the same manner as in Example 1, except that the subbing layer was prepared by using the following coating composition, and the thickness of the subbing layer was changed to 1.0 μm.

| Coating Composition for Subbing Layer: | |
|---|---|
| Modified (type-8) nylon (Lacquramide L5003, produced by Dainippon Ink and Chemicals, Inc.) | 14 parts |
| Methyl alcohol | 60 parts |
| n-Butyl alcohol | 40 parts |
| Water | 10 parts |

COMPARATIVE EXAMPLE 3

An electrophotographic photoreceptor was prepared in the same manner as in Example 1, except for using n-butyl acetate in place of chlorobenzene as a dispersing medium of the coating composition for the charge generating layer.

The electrophotographic photoreceptors prepared in Examples 1 to 8 and Comparative Examples 1 to 3 was evaluated with a laser printer (a remodeled machine of XP-11 manufactured by Fuji Xerox Co., Ltd.) under an ambient temperature and ambient humidity condition (20° C., 40% RH) or a low temperature and low humidity condition (10° C., 15% RH). The surface voltage of the photoreceptor was measured after charging ($V_H$), after exposure to laser light of 3 erg/cm$^2$ ($V_L$), and after exposure to light of 12 erg/cm$^2$ ($V_R$). Further, printing was actually conducted on the printer, and the image quality of the copies obtained was evaluated. The results obtained are shown in Table 1 below.

TABLE 1

| | 20° C., 40% RH | | | 10° C., 15% RH | | | |
|---|---|---|---|---|---|---|---|
| Example No. | $V_H$ | $V_L$ | $V_R$ | $V_H$ | $V_L$ | $V_R$ | Image Defect |
| Example 1 | −800 | −120 | −30 | −800 | −140 | −45 | none |
| Example 2 | −790 | −110 | −30 | −790 | −130 | −45 | " |
| Example 3 | −790 | −110 | −30 | −790 | −140 | −50 | " |
| Example 4 | −800 | −100 | −20 | −810 | −140 | −45 | " |
| Example 5 | −780 | −110 | −25 | −790 | −140 | −50 | " |
| Example 6 | −800 | −120 | −30 | −810 | −150 | −50 | " |
| Example 7 | −800 | −180 | −30 | −810 | −200 | −45 | " |
| Example 8 | −800 | −150 | −60 | −830 | −200 | −100 | " |
| Compar. Example 1 | −780 | −170 | −80 | −820 | −290 | −190 | " |
| Compar. Example 2 | −790 | −160 | −70 | −820 | −250 | −150 | " |
| Compar. Example 3 | −750 | −150 | −30 | −740 | −160 | −45 | unevenness in density |

The unevenness in density observed in Comparative Example 3 seemed to be attributed to poor dispersibility of the pigment.

The electrophotographic photoreceptor according to the present invention, characterized by a combination of a subbing layer mainly comprising an organometallic compound and a compatible binder resin and a charge generating layer formed by using a composition comprising hydroxygallium phthalocyanine crystals, a binder resin, and a halogenated benzene, exhibits high sensitivity and excellent stability on repeated use and is free from image defects which might have developed due to coating defects, as is clear from the results in Table 1.

While the invention has been described in detail and with reference to specific examples thereof, it will be apparent to one skilled in the art that various changes and modifications can be made therein without departing from the spirit and scope thereof.

What is claimed is:

1. An electrophotographic photoreceptor comprising a conductive substrate having thereon at least a subbing layer, a charge generating layer, and a charge transporting layer in this order, in which said subbing layer comprises an organometallic compound and a binder resin compatible with said organometallic compound, and said charge generating layer is a layer prepared by coating a coating composition comprising hydroxygallium phthalocyanine crystals as a charge generating material, a binder resin, and a halogenated benzene as a dispersing medium on said subbing layer, followed by drying.

2. An electrophotographic photoreceptor as claimed in claim 1, wherein said subbing layer further comprises a silane coupling agent, and said binder resin is also compatible with said silane coupling agent.

3. An electrophotographic photoreceptor as claimed in claim 1, wherein said binder resin is present in an amount of from 3 to 30% by weight based on said organometallic compound.

4. An electrophotographic photoreceptor as claimed in claim 2, wherein said binder resin is present in an amount of from 3 to 30% by weight based on the total amount of said organometallic compound and said silane coupling agent.

5. An electrophotographic photoreceptor as claimed in claim 1, wherein said organometallic compound is an organozirconium compound or an organotitanium compound.

6. An electrophotographic photoreceptor as claimed in claim 1, wherein said hydroxygallium phthalocyanine crystals have intense peaks at Bragg angles (20±0.2°) of 7.7°, 16.5°, 25.1°, , and 26.6° in X-ray diffraction using CuKα as a radiation source.

7. An electrophotographic photoreceptor as claimed in claim 1, wherein said hydroxygallium phthalocyanine crystals have intense peaks at Bragg angles (20±0.2°) of 7.9°, 16.5°, 24.4°, and 27.6° in X-ray diffraction using CuKα as a radiation source.

8. An electrophotographic photoreceptor as claimed in claim 1, wherein said hydroxygallium phthalocyanine crystals have intense peaks at Bragg angles (20±0.2°) of 7.5°, 9.9°, 12.5°, 16.3°, 18.6°, 25.1°, and 28.3° in X-ray diffraction using CuKα as a radiation source.

9. An electrophotographic photoreceptor as claimed in claim 1, wherein said hydroxygallium phthalocyanine crystals have intense peaks at Bragg angles (20±0.2°) of 6.8°, 12.8°, 15.8°, and 26.0° in X-ray diffraction using CuKα as a radiation source.

10. An electrophotographic photoreceptor as claimed in claim 1, wherein said hydroxygallium phthalocyanine crystals have intense peaks at Bragg angles (20±0.2°) of 7.0°, 13.4°, 16.6°, 26.6°, and 26.7° in X-ray diffraction using CuKα as a radiation source.

11. A process for producing an electrophotographic photoreceptor comprising a conductive substrate having thereon at least a subbing layer and a photosensitive layer, comprising forming a subbing layer comprising an organometallic compound and a binder resin compatible with said organometallic compound on a conductive substrate, and coating a dispersion of hydroxygallium phthalocyanine crystals, a binder resin, and a halogenated benzene as a dispersing medium on said subbing layer, followed by drying.

12. An electrophotographic photoreceptor as claimed in claim 1, wherein said subbing layer comprises a binder resin selected from the group consisting of polyurethane resins, polyvinyl butyral resins, polyvinyl formal resins and polyvinyl acetate resins.

13. An electrophotographic photoreceptor as claimed in claim 1, wherein said subbing layer comprises a zirconium compound of the formula:

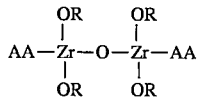

wherein R is a butyl group and AA is an acetylacetoxy group; and a polyvinyl butyral binder resin.

14. An electrophotographic photoreceptor as claimed in claim 1, wherein said subbing layer comprises a zirconium compound of the formula:

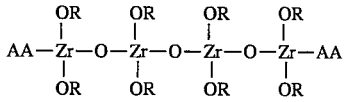

wherein R is a butyl group and AA is an acetylacetoxy group; and a polyvinyl butyral binder resin.

15. An electrophotographic photoreceptor as claimed in claim 1, wherein said organometallic compound comprises zirconium butyrate and acetylacetonezirconium butyrate and said binder resin compatible with said organometallic compound comprises a polyvinyl butyryl resin.

16. An electrophotographic photoreceptor as claimed in claim 1, wherein said subbing layer comprises zirconium butyrate, γ-aminopropyltriethoxysilane and a polyvinyl butyral binder resin.

17. An electrophotographic photoreceptor as claimed in claim 1, wherein said subbing layer comprises acetylacetonatotitanium, γ(2-aminoethyl) aminopropyltrimethoxysilane and a polyvinyl butyral binder resin.

18. An electrophotographic photoreceptor as claimed in claim 1, wherein said subbing layer comprises zirconium butyrate, acetylacetonezirconium butyrate and a polyvinyl butyral binder resin.

19. An electrophotographic photoreceptor as claimed in claim 1, wherein the thickness of the subbing layer is between 0.1 μm and 10 μm.

20. An electrophotographic photoreceptor as claimed in claim 1, wherein the thickness of the subbing layer is from 0.1 to 1.5 μm.

* * * * *